US010463075B2

(12) United States Patent
Beardsall

(10) Patent No.: US 10,463,075 B2
(45) Date of Patent: Nov. 5, 2019

(54) SNUFF CONTAINER

(71) Applicant: Swedish Match North Europe AB, Stockholm (SE)

(72) Inventor: Philip Beardsall, Örkelljunga (SE)

(73) Assignee: SWEDISH MATCH NORTH EUROPE AB, Stockholm (SE)

( * ) Notice: Subject to any disclaimer, the term of this patent is extended or adjusted under 35 U.S.C. 154(b) by 0 days.

(21) Appl. No.: 15/891,774

(22) Filed: Feb. 8, 2018

(65) Prior Publication Data

US 2019/0239562 A1 Aug. 8, 2019

(51) Int. Cl.

| | |
|---|---|
| ***A24F 23/00*** | (2006.01) |
| ***B65D 43/02*** | (2006.01) |
| ***B65D 51/28*** | (2006.01) |

(52) U.S. Cl.

CPC ..... *A24F 23/00* (2013.01); *B65D 43/0212* (2013.01); *B65D 51/2842* (2013.01);
(Continued)

(58) Field of Classification Search

CPC ..... B65D 2543/00092; B65D 2543/00296; B65D 2543/00583; B65D 43/0212;
(Continued)

(56) References Cited

U.S. PATENT DOCUMENTS 2,774,466 A * 12/1956 Liska
5,740,938 A * 4/1998 Hofmann ..... B65D 43/162 206/531

(Continued)

FOREIGN PATENT DOCUMENTS

EP 3106405 A1 12/2016
WO WO-2011/051077 A1 5/2011

(Continued)

OTHER PUBLICATIONS

International Search Report and Written Opinion dated Apr. 12, 2019 by the International Searching Authority for Patent Application No. PCT/EP2019/053100, which was filed on Feb. 8, 2019 (Applicant—Swedish Match North Europe AB) (14 pages).

*Primary Examiner* — Robert J Hicks
*Assistant Examiner* — Matusala K Tewolde
(74) *Attorney, Agent, or Firm* — Ballard Spahr LLP

(57) ABSTRACT

The present disclosure relates to a snuff container (1) comprising a base (2), wherein said base (2) comprises a bottom wall (21) and a base side wall (22), and wherein the base side wall (22) extends in a height direction (h) of the base (2) and circumferentially encloses a storing compartment (3) for snuff. The base side wall (22) comprises at least one first section (23) extending at least partially in the circumference of the base side wall (22), and the base side wall (22) further comprises at least one second section (24) extending at least partially in the circumference of the base side wall (22) between a first (241) and a second (242) circumferential end portion thereof. Moreover, the at least second section (24) presents a reduced bending stiffness in a direction being essentially perpendicular to the height direction (h) of the base side wall (22) and directed essentially inwardly towards a center of the snuff container (1) in relation to a corresponding bending stiffness of the at least one first section (23).

16 Claims, 5 Drawing Sheets

(52) U.S. Cl.
CPC ..... *B65D 2543/00092* (2013.01); *B65D 2543/00296* (2013.01); *B65D 2543/00583* (2013.01)

(58) Field of Classification Search
CPC ..... B65D 51/2842; B65D 1/40; B65D 11/20; B65D 50/04; B65D 83/04; B65D 45/22; B65D 2543/00925; B65D 2543/00824; A24F 23/00
USPC ..... 220/315, 660, 326, 324, 281, 691, 780, 220/205, 506; 206/242
See application file for complete search history.

(56) References Cited

U.S. PATENT DOCUMENTS

| | | | | |
|---|---|---|---|---|
| 8,393,465 | B2 * | 3/2013 | Clark | A24F 23/00 206/242 |
| 9,445,631 | B1 * | 9/2016 | Patel | A24F 23/00 |
| 9,908,670 | B2 * | 3/2018 | Patel | A24F 23/00 |
| 2008/0124954 | A1 | 5/2008 | Wei | |
| 2008/0202956 | A1 | 8/2008 | Welk et al. | |
| 2011/0186579 | A1 | 8/2011 | Bailey et al. | |
| 2011/0303566 | A1 * | 12/2011 | Gibson | A24F 23/00 206/246 |
| 2016/0106150 | A1 | 4/2016 | Garcia et al. | |
| 2016/0368670 | A1 * | 12/2016 | Beardsall | B65D 43/0212 |
| 2017/0369223 | A1 | 12/2017 | Beardsall | |

FOREIGN PATENT DOCUMENTS

| | | | |
|---|---|---|---|
| WO | WO-2014/124939 | A1 | 8/2014 |
| WO | WO-2016/202594 | A1 | 12/2016 |
| WO | WO-2017/125405 | A1 | 7/2017 |

* cited by examiner

SNUFF CONTAINER

TECHNICAL FIELD

The present disclosure relates to a snuff container comprising a base, wherein the base comprises a bottom wall and a base side wall, and wherein the base side wall extends in a height direction of the base and circumferentially encloses a storing compartment for snuff.

BACKGROUND

Snuff containers of different kinds are well known and are commonly used for storing snuff products. One important aspect of such containers is that they are able to maintain the freshness of the snuff products for a long time.

One example of a snuff container can be found in the international patent application with number WO 2014/124939 A1, which discloses a snuff container comprising a base and a lid.

Generally, known snuff containers are relatively easy to open by anyone, including a child.

SUMMARY

In view of the above, an object of the present invention is to provide an improved snuff container which provides an improved opening functionality. More precisely, an object of the present invention is to provide an improved snuff container which is child resistant to thereby reduce the risk that a child is able to open the container.

The above mentioned and other objects are at least partially provided by the subject matter as specified herein. Preferred and advantageous embodiments can be found in the depending claims and in the accompanying description and drawings.

According to a first aspect of the present invention, the objects are at least partially provided by a snuff container comprising a base, wherein the base comprises a bottom wall and a base side wall, and wherein the base side wall extends in a height direction of the base and circumferentially encloses a storing compartment for snuff. Moreover, the base side wall comprises at least one first section extending at least partially in the circumference of the base side wall, and the base side wall further comprises at least one second section extending at least partially in the circumference of the base side wall between a first and a second circumferential end portion thereof. The at least one second section presents a reduced bending stiffness in a direction being essentially perpendicular to the height direction of the base side wall and directed essentially inwardly towards a center of the snuff container in relation to a corresponding bending stiffness of the at least one first section.

By the above mentioned configuration, an improved snuff container is provided which reduces the risk that an unsuitable person gets access to the storing compartment, in particular a child. By having at least one second section configured as stated above, a first lid for the base may be removed only after a user pushes on the second section with the reduced bending stiffness in a direction being essentially perpendicular to the height direction of the base side wall. Thereby an increased safety may be provided since opening of the container may require at least two operations before removing the first lid in order to access the snuff in the storing compartment. This is especially advantageous since it may reduce the risk of children accessing the storing compartment. Hence, a first lid may first be connected and locked to the base and may only be removed after pushing on the at least one second section. Optionally, the at least one second section may be resiliently flexible. Furthermore, the present invention is also advantageous in that it provides a snuff container which is adapted such that senior people, or people with reduced hand strength, still may be able to open the container without any major difficulties. Still further, the above mentioned configuration provides a cost-efficient design which also provides an increased safety.

Optionally, the reduced bending stiffness of the at least one second section may also be defined as a weaker section in relation to the at least one first section.

Optionally, the at least one first section may extend in the remaining portion of the circumference of the base side wall where the at least one second section is not present.

Optionally, the at least one first section may comprise at least a first wall thickness profile in the height direction and the at least one second section may comprise at least a second wall thickness profile in the height direction, wherein the at least second wall thickness profile presents a reduced thickness in relation to a thickness of the at least first wall thickness profile. By having a reduced thickness in relation to a thickness of the at least one first section, a reduced bending stiffness may be provided for the at least one second section.

Optionally, a reduced bending stiffness may be provided in that the at least one second section comprising a material being different or having different properties in relation to a material of the at least one first section, wherein the material of the at least one second section has a reduced bending stiffness in relation to the material of the at least one first section.

Optionally, the base side wall may be a substantially cylindrically shaped envelope surface of a cylinder, preferably of a tubular shape. Still optionally, the base side wall is substantially oval shaped. By having a substantially round, or curved, outer shape without any sharp corners, a further improved snuff container may be provided. Still further, a continuous outer shape without any sharp or distinct corners may provide an increased safety in that it will be more difficult for e.g. a child to identify how and where to push on the base side wall in order to open the container.

Optionally, the base side wall on an outer circumferential surface thereof may comprise a base seat surface directed away from the bottom wall in the height direction. Still optionally, the base seat surface may extend around the complete circumference of the outer circumferential surface of the base side wall.

Optionally, an angle $\alpha$ between a first and a second line which extend from a center of the base and intersect the first and the second respective end portions of the at least one second section may be from 10 to 180 degrees, or the angle may be in anyone of the following intervals:

10, 20, 30, 40, 50, 60, 70, 80, $\leq\alpha\leq$90, 100, 110, 120, 130, 140, 150, 160, 170, 180 Anyone of the aforementioned minimum and maximum angles may be combined.

Alternatively, the angle $\alpha$ may extend in a portion of the circumference of the base which corresponds to substantially 3-50% of the total circumference of the base, such as 5-50, 10-50, 15-50, 20-50 or 25-50% of the circumference.

Optionally, the container may further comprise a first lid configured for being connected to the base for closing the container.

Optionally, the first lid may be configured for being releasably connected to the base. Still optionally, the first lid may be connected to the base via a hinge or the like.

Optionally, the base side wall on the outer circumferential surface thereof may comprise a base locking portion for locking the first lid to the base, wherein the base locking portion extends at least partially in the circumference of the outer circumferential surface of the base side wall. Just as a matter of example, the base locking portion may comprise at least one ridge or groove which extends at least partially in the circumference of the outer circumferential surface of the base side wall. Optionally, the at least one ridge or groove may extend around the complete circumference of the outer circumferential surface of the base side wall.

Optionally, the first lid may further comprise a top wall and a lid side wall which extends in a height direction of the first lid, wherein the lid side wall is configured to circumferentially enclose a portion of the base side wall when connected to the base and when the container is closed.

Optionally, the lid side wall may comprise a lid seat surface on a height end side of the lid side wall which is directed away from the top wall, wherein the lid seat surface is configured such that it substantially contacts the base seat surface when the container is closed, thus making a split-line between the first lid and the base virtually imperceptible. Thereby an improved child resistance may be provided since it will be more difficult to open the container without pushing on the at least one second section.

Optionally, the container may be configured such that:

when the container is closed and when the at least one second section is pushed inwardly in the direction being essentially perpendicular to the height direction of the base side wall, the lid seat surface is at least partially exposed and accessible, allowing the first lid to be pried away from the base by inserting a finger under the exposed lid seat surface.

Optionally, the at least one first section presents a bending stiffness in the perpendicular direction which is sufficient for preventing a user to push on the section such that the lid seat surface is exposed and accessible.

Optionally, when the container is closed, the first lid and the base together may form a circumferentially outer container side surface which is a substantially continuous cylindrically shaped surface. Thereby an improved child resistance may be provided since it will be more difficult to open the container by inserting a finger nail between the first lid and the base without pushing on the at least one second section.

Optionally, the lid side wall on a circumferentially inner side thereof may comprise a lid locking portion for locking the first lid to the base, wherein the lid locking portion extends at least partially in the circumference of the inner circumferential surface of the lid side wall. In one non-limiting example, the lid locking portion may be a ridge or a groove.

Optionally, the base may further comprise a means for identifying the location of the at least one second section by a user on a circumferentially outer surface of the base side wall at the at least one second section. Such a means may for example be something which can be visually recognized, such as different colorings or markings of some kind. Additionally, such means could also be something which could be haptically sensed by a user, such as protrusions, recesses etc. In one non-limiting example, such means may be protruding dots which can be sensed and/or seen by a user.

Optionally, the container may be made of a plastic material, preferably a polymer, such as a thermoplastic polymer material. Just as a matter of example, the container may be made of a polyolefin, such as polypropylene and polyethylene. Still optionally, the container may be made of a material which is strong enough such that it may not easily be teared open by for example a child. For example, some paper, paperboard or cardboard materials which are not strong enough or not resilient enough may preferably not be used.

Optionally, the container may be produced by an injection molding process. This is a cost-efficient process, especially when producing large amounts of products.

Optionally, the first lid may further comprise an additional compartment for storing used snuff. Still optionally, the container may further comprise a second lid configured for being connected to the first lid for closing the additional compartment.

Optionally, an inner circumferential side of the base side wall facing the storing compartment for snuff may be configured such that the storing compartment presents an increased width, or diameter, in the direction towards the bottom wall. Thereby, an undercut is obtained. Such a design may facilitate opening and closing functionality of the container.

The terms "snuff" and "snuff product" are used herein to refer to any kind of smokeless tobacco products and non-tobacco products for oral use.

A non-tobacco snuff product may be any composition as known in the art for use in the oral cavity and may comprise plant material other than tobacco material, cellulose such as microcrystalline cellulose, fillers, flavorants, and active ingredients such as nicotine, caffeine, etc.

Smokeless tobacco for oral use includes chewing tobacco, dry snuff and moist (wet) snuff. Generally, dry snuff has moisture content of less than 10 wt % and moist snuff has a moisture content of above 40 wt %. Semi-dry products having between 10% to 40 wt % moisture content are also available.

Smokeless tobacco products for oral use are made from tobacco leaves, such as lamina and stem of the tobacco leaf. The material from roots and stalks are normally not utilized for production of smokeless tobacco compositions for oral use.

There are two types of moist snuff, the American type and the Scandinavian type which is also called snus. American-type moist snuff is commonly produced through a fermentation process of moisturized ground or cut tobacco. Scandinavian-type moist snuff (snus) is commonly produced by using a heat-treatment process (pasteurization) instead of fermentation. The heat-treatment is carried out in order to degrade, destroy or denature at least a portion of the micro-organisms within the tobacco preparation.

Both the American-type and the Scandinavian-type of moist snuff for oral use are available in loose form or portion-packed in a saliva-permeable, porous wrapper material forming a pouch. Pouched moist snuff, including snus, is typically used by the consumer by placing the pouch between the upper or lower gum and the lip and retaining it there for a limited period of time. The pouch material holds the tobacco in place while allowing saliva to pass into the tobacco and allowing flavours and nicotine to diffuse from the tobacco material into the consumer's mouth.

By "tobacco" is meant any part, e.g., leaves, stems, and stalks, of any member of the genus *Nicotiana*. The tobacco may be whole, shredded, threshed, cut, ground, cured, aged, fermented, or otherwise, e.g., granulated or encapsulated.

"Oral" and "oral use" is in all contexts used herein as a description for use in the oral cavity, such as buccal placement. The product is then intended for placement within the oral cavity, such that the product as a whole is contained in the oral cavity.

"Pouched smokeless tobacco product for oral use" or "oral pouched smokeless tobacco product" refers to a portion of smokeless tobacco packed in a saliva-permeable pouch material intended for oral use.

According to a second aspect, the objects are at least partially provided by a method of manufacturing a snuff container according to anyone of the embodiments of the first aspect of the invention. Advantages and effects of the second aspect are largely analogous to the advantages and effects as specified in relation to the first aspect of the invention.

Optionally, the container may be manufactured by an injection molding process. Still optionally, in the case when the container presents a first and a second thickness profile as specified herein, the different thickness profiles may be accomplished directly in the injection molding process. Alternatively, the reduced thickness profile may be obtained in another process step, such as by grinding or cutting away material from the base side wall.

BRIEF DESCRIPTION OF DRAWINGS

Exemplifying and preferred embodiments of the present invention will now be described more in detail, with reference to the accompanying drawings, wherein.

Figure 1:
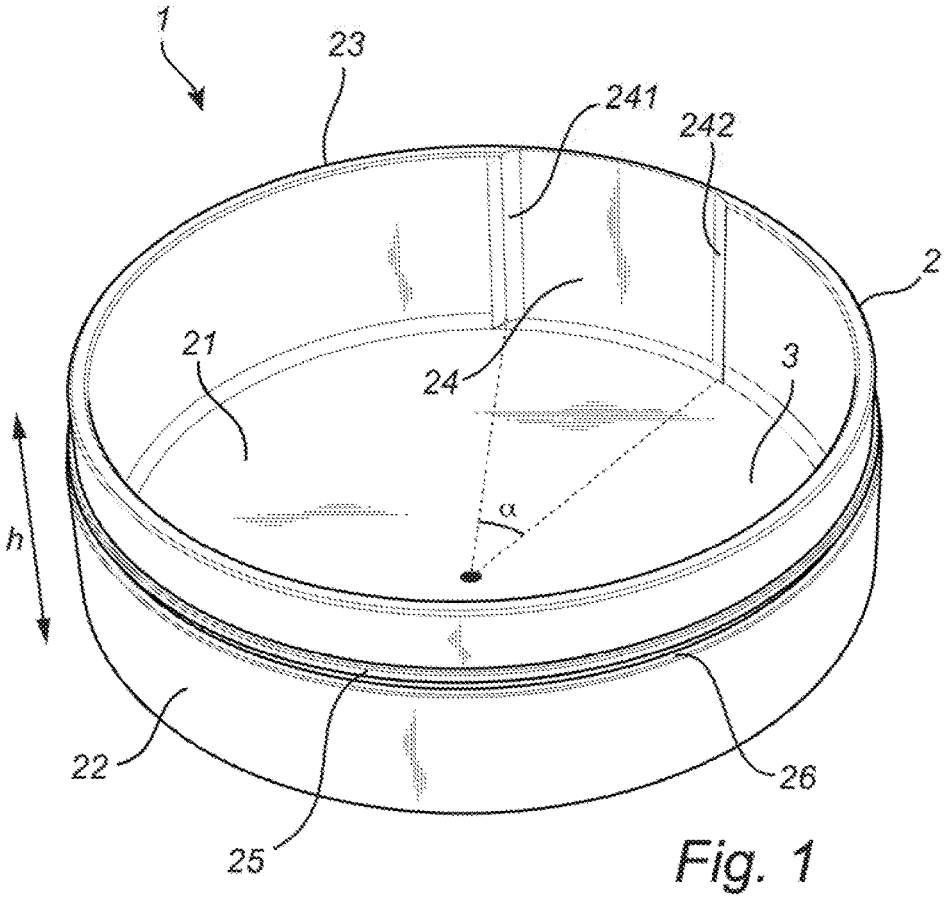
FIG. 1 shows a perspective view of a snuff container comprising a base according to an example embodiment of the present invention.

The drawings show exemplifying embodiments of the present invention and are thus not necessarily drawn to scale. It shall be understood that the embodiments shown and described are exemplifying and that the invention is not limited to these embodiments. It shall also be noted that some details in the drawings may be exaggerated in order to better describe and illustrate the invention. Like reference characters refer to like elements throughout the description, unless expressed otherwise.

DETAILED DESCRIPTION OF EXAMPLE EMBODIMENTS OF THE INVENTION

In FIG. 1, a perspective view of a snuff container 1 according to an example embodiment of the present invention is depicted. The snuff container 1 comprises a base 2, wherein the base 2 comprises a bottom wall 21 and a base side wall 22. The base side wall 22 extends in a height direction, see e.g. ref. h in FIG. 2, of the base 2 and circumferentially encloses a storing compartment 3 for snuff. Moreover, the base side wall 22 comprises one first section 23 extending at least partially in the circumference of the base side wall 22, and the base side wall 22 further comprises one second section 24 extending at least partially in the circumference of the base side wall 22 between a first 241 and a second 242 circumferential end portion thereof. The second section 24 presents a reduced bending stiffness in a radial extension r (see FIG. 2) of the base 2 which is essentially perpendicular to the height direction h of the base side wall 22 and directed essentially inwardly towards a center of the snuff container 1 in relation to a corresponding bending stiffness of the first section 23. As can be seen in FIG. 1, the end portions 241 and 242 are offset from each other along the circumference of the base 2 by an angle $\alpha$. The angle $\alpha$ is defined as an angle between a first and a second line which extend from a center of the base 2 and intersect the first and the second respective end portions, 241 and 242, of the second section 24. In the case when the base is not circular, or round, the center of the base may be defined as a mass center of the base. The angle $\alpha$ may be from 10 to 180 degrees, from 10 to 80 degrees, from 10 to 70 degrees, from 10 to 60 degrees, from 10 to 50 degrees, from 10 to 40 degrees, from 10 to 35 degrees, from 10 to 30 degrees, from 10 to 25 degrees. As an alternative, the first and second respective end portions, 241 and 242, may be offset by a distance such that the distance substantially corresponds to the width of a finger, for example a thumb, of a user. For example, such a distance may be in the range from 1 centimeter to 5 centimeters, such as 2 to 4 centimeters, on the outer circumferential surface of the base side wall 22.

Moreover, as can be seen in FIG. 1, the base 2 in this example presents a substantially circular shape. However, the present invention is not limited only to this type of shape, and therefore the base 2 could also have other shapes, such as a substantially oval shape or any other suitable shape recognized by a skilled person. Still further, the base 2 comprises a base locking portion 25 for locking a first lid 4 (not shown in this figure) to the base 2 and also a base seat surface 26.

Figure 2:
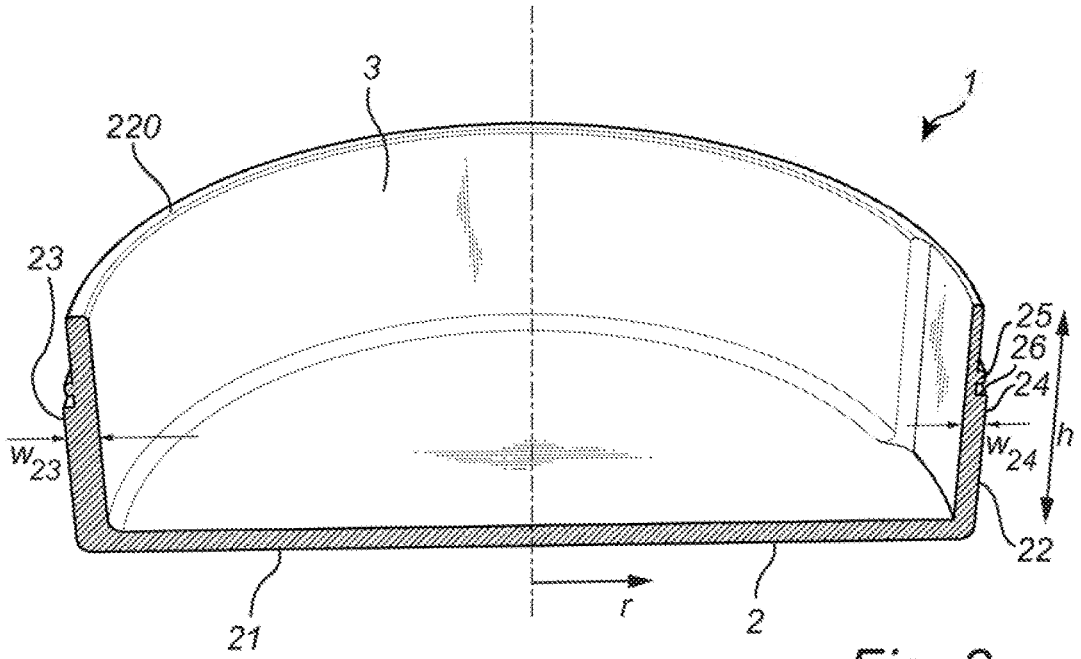
FIG. 2 shows a cross sectional view of the snuff container as seen in FIG. 1.

Now turning to FIG. 2, a cross sectional view of the snuff container 1 as seen in FIG. 1 is depicted. The cross section is made such that it cuts through the first section 23 and the second section 24, and is further represented by a plane extending parallel to the height direction h. As can be seen, the second section 24 comprises a second wall thickness profile $w_{24}$, which extends from the bottom wall 21 to a top surface 220 of the base side wall 22. As can be further seen, the second wall thickness profile $w_{24}$ presents two different thicknesses along the height direction h of the base side wall 22. This will be further detailed in relation to FIG. 4 hereinbelow. Moreover, the first section 23 comprises a first wall thickness profile $w_{23}$, which also extends from the bottom wall 21 to the top surface 220 of the base side wall 22. The first wall thickness profile $w_{23}$ also presents two different thicknesses along the height direction h of the base side wall 22. The second wall thickness profile $w_{24}$ presents a reduced thickness in relation to the thickness of the first wall thickness profile $w_{23}$. Optionally, the reduction may be in the range of 10-80% of the thickness of the first wall thickness profile $w_{23}$, such as any of 20-80%, 30-80%, 40-80% and 50-80%, or 20-60%, 30-60%, 40-60% and 50-60%. By having a reduced thickness profile in relation to a thickness profile of the first section 23, a reduced bending stiffness may be provided for the second section 24. As can be seen in this embodiment, the reduced thickness has been accomplished by making a recess on the inner circumferential side of the base side wall 22. Thereby, the outer circumferential surface of the base side wall 22 may be continuous without any virtually or tactilely identifiable recesses or the like.

Additionally, the base locking portion 25 can also be seen in FIG. 2. In this embodiment, the base locking portion 25 is a ridge that extends around the outer circumference of the base side wall. Below the base locking portion is the base seat surface 26 located, which is meant to at least partially receive the lid seat surface 43 as seen in for example FIG. 3.

Figure 3:
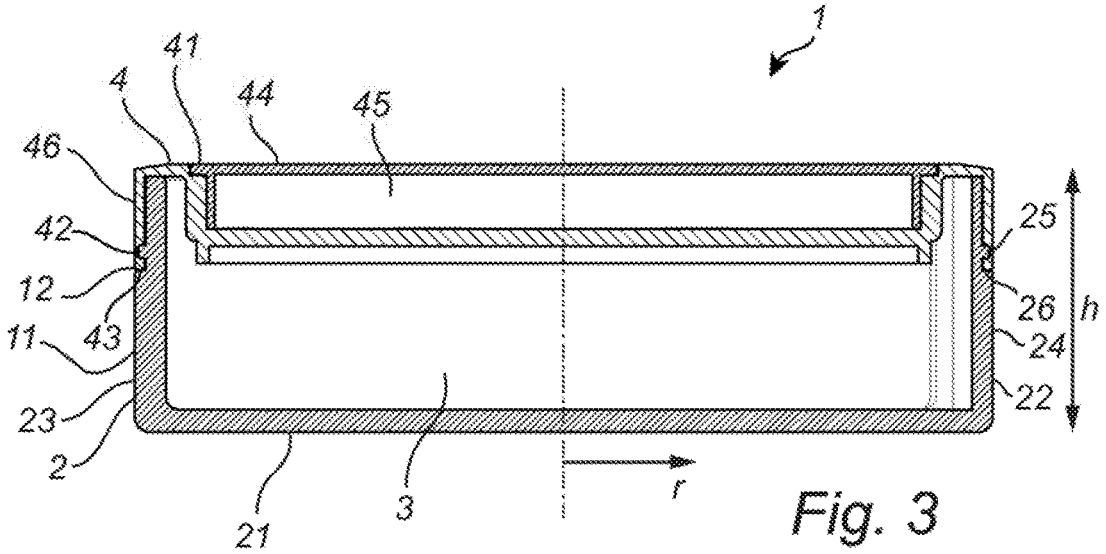
FIG. 3 shows a cross sectional view of a snuff container comprising a base and a first lid according to an example embodiment of the present invention.

In FIG. 3, a snuff container 1 which also comprises a first lid 4 is depicted. The base 2 is here similar to the base 2 as described in relation to FIGS. 1 and 2, and therefore only the first lid 4 will be described in more detail in this section.

The first lid 4 is configured for being connected to the base 2 for closing the container 1, and thereby seal off the storing compartment 3 from the external environment. In this example embodiment, the first lid 4 is releasably connected to the base 2. Alternatively, the first lid 4 may be connected to the base 2 via a hinge (not shown) or the like. However, the present example provides a snuff container 1 which is easy to produce. The first lid 4 comprises a top wall 41 and a lid side wall 46 which extends in a height direction h of the first lid 4, wherein the lid side wall 46 circumferentially encloses a portion 27, see FIG. 4 for details, of the base side wall 22 when connected to the base 2 and when the container 1 is closed. The first lid 4 is locked to the base 2 via the base locking portion 25 and a lid locking portion 42. In this example, the base locking portion is a ridge and the lid locking portion 42 is a corresponding recess, or groove, on the inner circumferential side of the lid side wall 46. A skilled person would recognize that the locking functionality is not limited to this specific example, but could of course also be configured differently. This specific example has, however, shown to provide a sufficiently strong locking for preventing a child to open the container. Moreover, this specific locking has also shown to be advantageous in that it is relatively easy to manufacture. Still further, the ridge/recess configuration could of course also be reversed between the first lid 4 and the base 2.

As can be further seen in FIG. 3, the base seat surface 43 is in direct contact with a lid seat surface 26 of the first lid. This configuration leads to that there will be a smooth split-line 12 without any gap between the base 2 and the first lid 4, and thereby it will be difficult for anyone to reach in-between the two seat surfaces, 43 and 26 respectively. For example, the container 1 may be configured such that the split-line 12 on the outer circumferential surface 11 of the container 1 is so small/narrow such that a nail of a person cannot be inserted therebetween. This assures that the container 1 will be very difficult to open without first pushing on the second section 24 of the base 2 to gain access to the lid seat surface. Thereby, it will be more difficult for a child to open the container 1. The first lid 4 as seen in FIG. 3 also comprises an additional storing compartment 45 for storing used snuff, also known as a disposal compartment. The storing compartment 45 is closed by a second lid 44.

Figure 4:
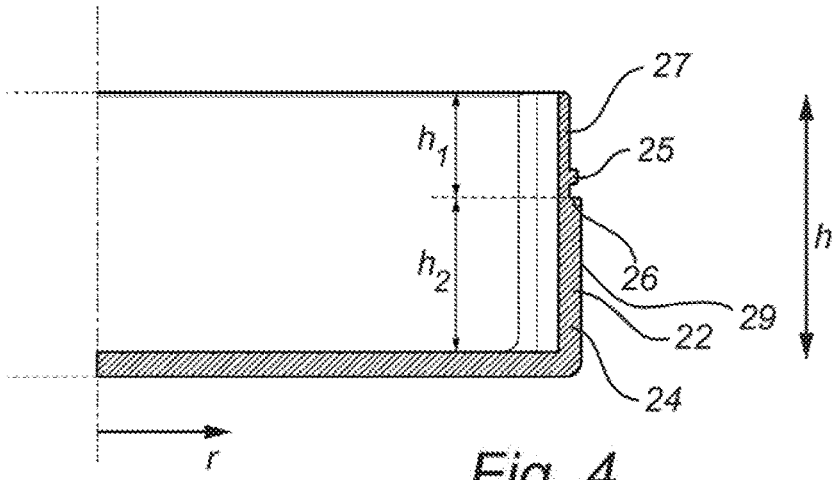
FIG. 4 shows a cross sectional view of a base side wall according to an example embodiment of the present invention.

Now turning to FIG. 4, a cross sectional view of a base 2 according to an example embodiment of the present invention is depicted. Here it is more clearly shown that the base side wall 22 is divided into two portions, 27 and 29 respectively, which present different thicknesses. The portion 27 extends a distance $h_1$ and the portion 29 extends a distance $h_2$ along the height direction h, and thereby a specific wall thickness profile is obtained. The portion 27 is thinner than the portion 29, and by this configuration the lid side wall 46 in FIG. 4 may advantageously enclose the portion 27. Moreover, the circumferentially outer container side surface 11 of the container will attain a continuous, and substantially smooth, cylindrical outer surface 11. The portions 27 and 29 are delimited by the base seat surface 26.

Figure 5:
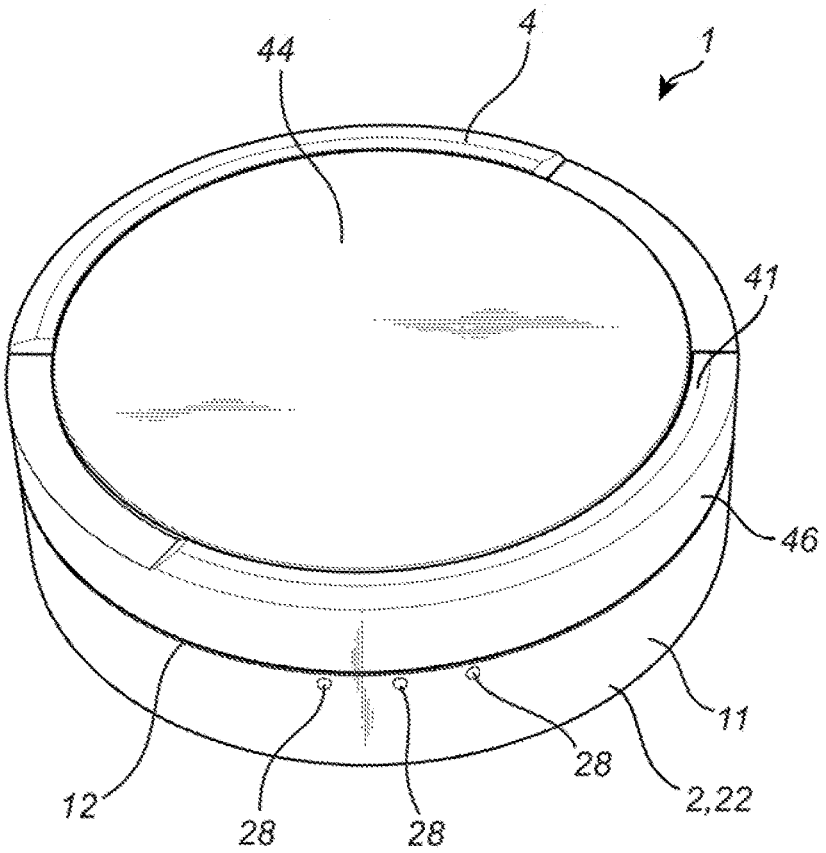
FIG. 5 shows a perspective view of a snuff container comprising a base and a first lid according to an example embodiment of the present invention.

In FIG. 5, a snuff container 1 comprising a base 2, a first lid 4 and a second lid 44 according to an example embodiment is depicted. Here it can be seen that the outer circumferential surface 11 of the container 1 is a substantially continuous cylindrically shaped surface, whereby only a small/narrow split-line 12 can be seen between the base 2 and the first lid 4. The split-line 12 is so small that it is impossible, or at least very difficult, for anyone to reach in-between the two seat surfaces 26 and 43. Moreover, in this example embodiment, means 28 for identifying the location of the at least one second portion 24 can be seen. The means in this example are protrusions, or dots, 28 which are located at the second section 24 on the outer circumferential surface of the base side wall 22. Thereby it will be possible for a user to visually and/or by touch to identify where to push for opening the container 1. The means 28 may of course be anything else that could be used for visual and/or tactile identification, such as different colorings, other types of protrusions/recesses etc. Just as a matter of example, the means may be grooves or the like located such that they are proximate a peripheral edge between the side wall 22 and the bottom wall 21. Moreover, the container 1 in this example presents an outer circular shape, and as can be seen the container 1 resembles the form of a hockey puck, which is a preferred shape. As already mentioned hereinabove, the outer shape is not limited to this type of shape, but could of course also for example be oval-shaped or any other suitable shape without departing from the invention.

Figure 6:
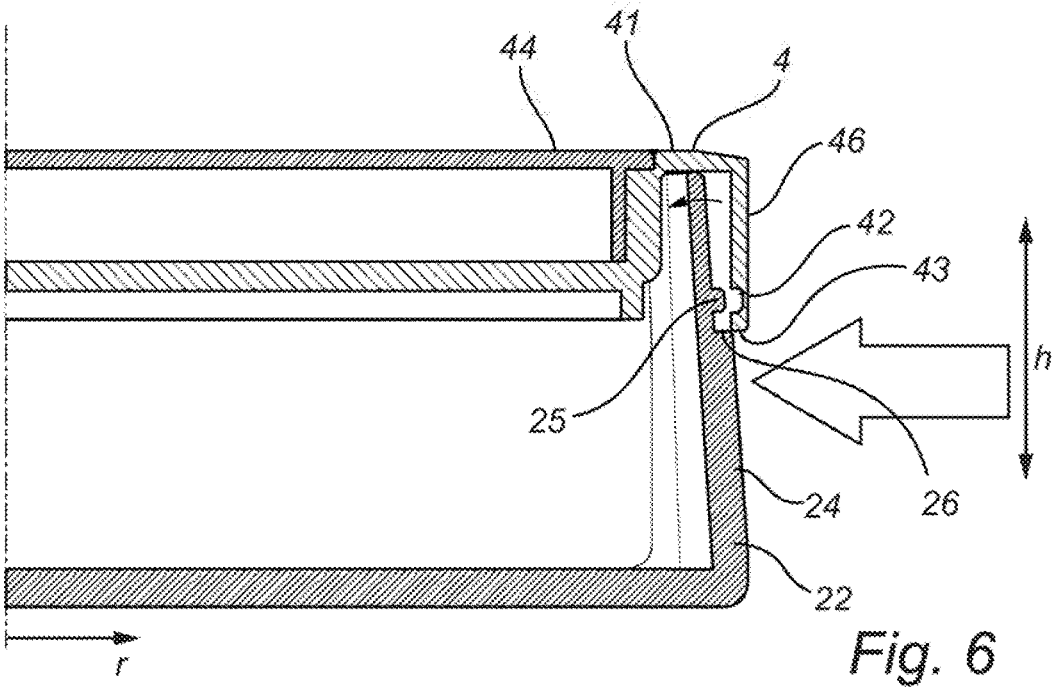
FIG. 6 shows a cross sectional view of a snuff container according to an example embodiment of the present invention, wherein the at least one second section is pushed inwardly.

In FIG. 6, a snuff container 1 according to an example embodiment is depicted. Here it can be more clearly seen how the container 1 can be opened by pushing inwardly (represented by the arrow) on the second section 24 in the radial extension r of the base 2. When the container 1 is closed and when the second section 24 is pushed inwardly in the r direction being essentially perpendicular to the height direction h of the base side wall 22, the lid seat surface 43 is at least partially exposed and accessible for a user. Thereby it will be possible to reach the lid seat surface 43 and pry open the container 1 by pushing on the lid seat surface 43 upwardly in the height direction h. Thus, the opening operation will require two steps, first pushing inwardly on the section 24 in the r direction and then pushing upwardly on the lid seat surface 43 in the h direction. These steps may be performed sequentially or simultaneously. When the section 24 is pushed inwardly, the locking portions 43 and 25 may also be partially released, at least at the section 24. However, it is not necessary that the locking portions 43 and 25 are released to such an extent as shown in the figure since a user may still be able to pry open the container 1 even if the locking portions 43 and 25 are still in contact by pushing on the lid seat surface 43.

Figure 7:
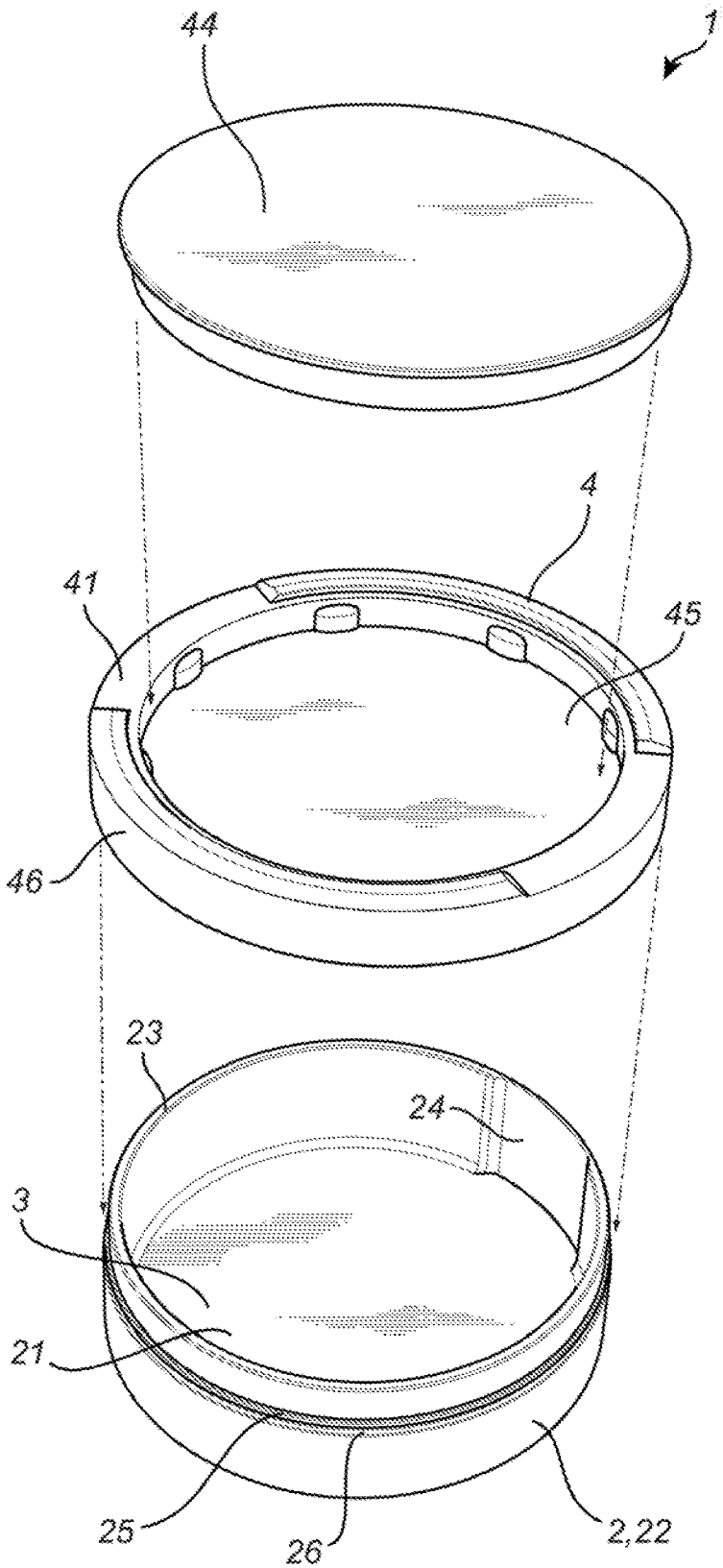
FIG. 7 shows a perspective view in an exploded view of an example embodiment of a container according to the present invention which comprises a base, a first lid and a second lid.

FIG. 7 shows an example embodiment of a snuff container 1 where the base 2, the first lid 4 and the second lid 44 are separated. Fresh snuff may be stored in the storing compartment 3 and used snuff may be stored in the additional compartment 45.

Figure 8A:
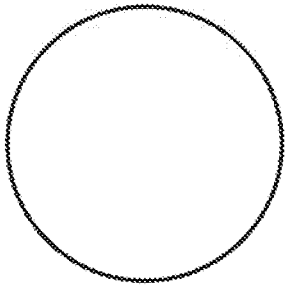
FIGS. 8*a-d* show schematic illustrations of example embodiments of snuff containers according to the present invention as seen in cross section.
Figure 8B:
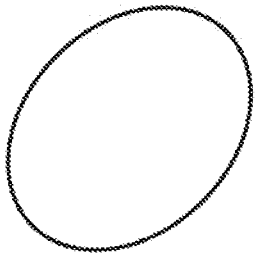
Figure 8C:
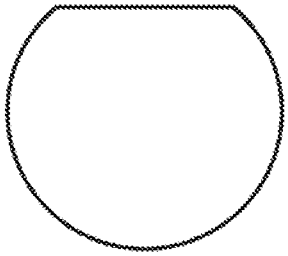
Figure 8D:
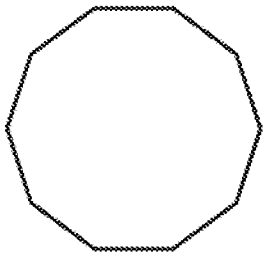

FIGS. 8*a* to 8*d* show different schematic examples of how a snuff container 1 according to the present invention may be shaped. The illustrations represent cross sections which are perpendicular to the height direction h of the container 1. FIG. 8*a* shows a circular outer shape as also shown in relation to the embodiments disclosed in FIGS. 1 to 7. FIG. 8*b* shows an oval outer shaped container 1. FIG. 8*c* shows a substantially circular outer shaped container 1 which also presents a substantially straight side. The substantially straight side may in one example be a side which presents the second section 24 according to an embodiment of the present invention. Lastly, FIG. 8*d* shows a container 1 which presents a polygonal shape with several straight sides, in this case 10 sides. The container 1 may of course also have other outer shapes. Herein the phrases circumference and circumferential are used for describing the snuff container. Said expressions could alternatively be phrased as a perimeter of a snuff container. More specifically, circumference and circumferential do not necessarily imply that the container is circular, but the container could also have other shapes as outlined herein.

Figure 9:
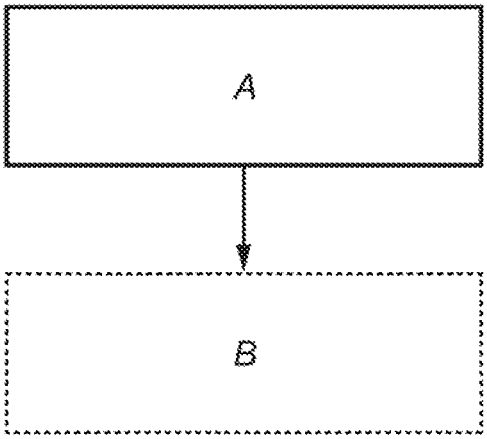
FIG. 9 shows a flowchart of an example embodiment of a manufacturing method according to the present invention.

In FIG. 9, a flowchart presenting an example embodiment of a method for manufacturing a snuff container is depicted. In step A, the snuff container 1 is injection molded. Optionally, if the container 1 presents different thickness profiles, $w_{23}$ and $w_{24}$, the different profiles may be obtained directly in step A. As an alternative, the thickness profiles may also be obtained in another step B in a grinding or cutting operation.

The invention is not limited to the embodiments described herein. It would be evident for the skilled person that other embodiments and modifications to the embodiments specified hereinabove are also possible within the scope of the claims. For example, the containers 1 as described in the above embodiments have shown one second section, but they could also comprise more than one second section with intervening first sections. Moreover, the reduced bending stiffness of the second section has been accomplished by a reduced thickness profile, which is a preferred embodiment, but could also be accomplished in other ways, such as introducing a second material with a reduced bending stiffness in the second section. This may be accomplished in an injection molding process. Alternatively, the reduced bending stiffness of the second section may be accomplished by introducing weakenings, such as grooves or perforations, preferably on the inner circumferential side of the base side wall, along the height direction and at the end portions of the second section.

Aspects

In view of the described snuff container and methods and variations thereof, herein below are described certain more particularly described aspects of the inventions. These particularly recited aspects should not however be interpreted to have any limiting effect on any different claims containing different or more general teachings described herein, or that the "particular" aspects are somehow limited in some way other than the inherent meanings of the language used therein.

Aspect 1: A snuff container comprising a base, wherein said base comprises a bottom wall and a base side wall, and wherein the base side wall extends in a height direction of the base and circumferentially encloses a storing compartment for snuff, wherein the base side wall comprises at least one first section extending at least partially in the circumference of the base side wall, and wherein the base side wall further comprises at least one second section extending at least partially in the circumference of the base side wall between a first and a second circumferential end portion thereof, wherein the at least one second section presents a reduced bending stiffness in a direction being essentially perpendicular to the height direction of the base side wall and directed essentially inwardly towards a center of the snuff container in relation to a corresponding bending stiffness of the at least one first section.

Aspect 2: The snuff container according to aspect 1, wherein the at least one first section comprises at least a first wall thickness profile in the height direction and the at least one second section comprises at least a second wall thickness profile in the height direction, wherein the at least second wall thickness profile presents a reduced thickness in relation to a thickness of the at least first wall thickness profile.

Aspect 3: The snuff container according to any one of the preceding aspects, wherein the base side wall is a substantially cylindrically shaped envelope surface of a cylinder, preferably of a tubular shape.

Aspect 4: The snuff container according to any one of the preceding aspects, wherein the base side wall on an outer circumferential surface thereof comprises a base seat surface directed away from the bottom wall in the height direction.

Aspect 5: The snuff container according to any one of the preceding aspects, wherein an angle between a first and a second line which extend from a center of the base and intersect the first and the second respective end portions of the at least one second section is from 10 to 180 degrees.

Aspect 6: The container according to any one of the preceding aspects, further comprising a first lid configured for being connected to the base for closing the container.

Aspect 7: The container according to aspect 6, wherein the first lid is configured for being releasably connected to the base.

Aspect 8: The container according to any one of the preceding aspects, wherein the base side wall on the outer circumferential surface thereof comprises a base locking portion for locking the first lid to the base, wherein the base locking portion extends at least partially in the circumference of the outer circumferential surface of the base side wall.

Aspect 9: The container according to any one of aspects 6-8, wherein the first lid further comprises a top wall and a lid side wall which extends in a height direction of the first lid, wherein the lid side wall is configured to circumferentially enclose a portion of the base side wall when connected to the base and when the container is closed.

Aspect 10: The container according to aspects 4 and 9, wherein the lid side wall comprises a lid seat surface on a height end side of the lid side wall which is directed away from the top wall, wherein the lid seat surface is configured such that it substantially contacts the base seat surface when the container is closed.

Aspect 11: The container according to aspect 10, wherein the container is configured such that:

when the container is closed and when the at least one second section is pushed inwardly in the direction being essentially perpendicular to the height direction of the base side wall, the lid seat surface is at least partially exposed and accessible.

Aspect 12: The container according to any one of aspects 9-11, wherein, when the container is closed, the first lid and the base together form a circumferentially outer container side surface which is a substantially continuous cylindrically shaped surface.

Aspect 13: The container according to any one of aspects 9-12, wherein the lid side wall on a circumferentially inner side thereof comprises a lid locking portion for locking the first lid to the base, wherein the lid locking portion extends at least partially in the circumference of the inner circumferential surface of the lid side wall.

Aspect 14: The container according to any one of the preceding aspects, wherein the base further comprises a means for identifying the location of the at least one second section by a user on a circumferentially outer surface of the base side wall at the at least second section.

Aspect 15: The container according to any one of the preceding aspects, wherein the at least second section is resiliently flexible in the direction presenting the reduced bending stiffness.

Aspect 16: The container according to any one of the preceding aspects, wherein the container is made of a plastic material, preferably a polymer.

Aspect 17: A method for manufacturing a snuff container according to any one of the preceding aspects.

The invention claimed is:

1. A snuff container comprising a base, wherein said base comprises a bottom wall and a base side wall, and wherein the base side wall extends in a height direction of the base and circumferentially encloses a storing compartment for snuff, wherein the base side wall comprises at least one first section extending at least partially in the circumference of the base side wall, and wherein the base side wall further comprises at least one second section extending at least partially in the circumference of the base side wall between a first and a second circumferential end portion thereof, wherein the at least one second section presents a reduced bending stiffness in a direction being essentially perpendicular to the height direction of the base side wall and directed essentially inwardly towards a center of the snuff container in relation to a corresponding bending stiffness of the at least one first section, wherein the reduced bending stiffness is provided in that the at least one first section comprises at least a first wall thickness profile in the height direction and the at least one second section comprises at least a second wall thickness profile in the height direction, wherein the at least second wall thickness profile presents a reduced thickness in relation to a thickness of the at least first wall thickness profile, wherein the reduced thickness is accomplished by a recess provided on the inner circumferential side of the base side wall.

2. The snuff container according to claim 1, wherein the base side wall is a substantially cylindrically shaped envelope surface of a cylinder.

3. The snuff container according to claim 1, wherein the base side wall on an outer circumferential surface thereof comprises a base seat surface directed away from the bottom wall in the height direction.

4. The snuff container according to claim 1, wherein an angle between a first and a second line which extend from a center of the base and intersect the first and the second respective end portions of the at least one second section is from 10 to 180 degrees.

5. The container according to claim 1, further comprising a first lid configured for being connected to the base for closing the container.

6. The container according to claim 5, wherein the first lid is configured for being releasably connected to the base.

7. The container according to claim 5, wherein the base side wall on the outer circumferential surface thereof comprises a base locking portion for locking the first lid to the base, wherein the base locking portion extends at least partially in the circumference of the outer circumferential surface of the base side wall.

8. The container according to claim 5, wherein the first lid further comprises a top wall and a lid side wall which extends in a height direction of the first lid, wherein the lid side wall is configured to circumferentially enclose a portion of the base side wall when connected to the base and when the container is closed.

9. The container according to claim 8, wherein the lid side wall comprises a lid seat surface on a height end side of the lid side wall which is directed away from the top wall, wherein the lid seat surface is configured such that it substantially contacts the base seat surface when the container is closed.

10. The container according to claim 9, wherein the container is configured such that:

when the container is closed and when the at least one second section is pushed inwardly in the direction being essentially perpendicular to the height direction of the base side wall, the lid seat surface is at least partially exposed and accessible.

11. The container according to claim 8, wherein, when the container is closed, the first lid and the base together form a circumferentially outer container side surface which is a substantially continuous cylindrically shaped surface.

12. The container according to claim 8, wherein the lid side wall on a circumferentially inner side thereof comprises a lid locking portion for locking the first lid to the base, wherein the lid locking portion extends at least partially in the circumference of the inner circumferential surface of the lid side wall.

13. The container according to claim 1, wherein the base further comprises a means for identifying the location of the at least one second section by a user on a circumferentially outer surface of the base side wall at the at least second section.

14. The container according to claim 1, wherein the at least second section is resiliently flexible in the direction presenting the reduced bending stiffness.

15. The container according to claim 1, wherein the container is made of a plastic material.

16. A method for manufacturing the snuff container according to claim 1, the method comprising a step of injection molding the snuff container.

* * * * *